US009158272B2

(12) United States Patent
Okabe

(10) Patent No.: US 9,158,272 B2
(45) Date of Patent: Oct. 13, 2015

(54) IMAGE FORMING APPARATUS HAVING MOVABLE SUPPORTING MEMBER FOR SUPPORTING CARTRIDGE

(71) Applicant: Yasushi Okabe, Nagoya (JP)

(72) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/228,292

(22) Filed: Mar. 28, 2014

(65) Prior Publication Data

US 2014/0294425 A1 Oct. 2, 2014

(30) Foreign Application Priority Data

Mar. 29, 2013 (JP) ..... 2013-074690

(51) Int. Cl.
*G03G 21/18* (2006.01)

(52) U.S. Cl.
CPC .... *G03G 21/1871* (2013.01); *G03G 2215/0141* (2013.01); *G03G 2221/1684* (2013.01)

(58) Field of Classification Search
CPC ..... G03G 21/1871; G03G 2215/0141; G03G 2221/1684; G03G 15/0105; G03G 21/16; G03G 21/1604; G03G 21/1642; G03G 21/1676; G03G 21/1652; G03G 21/1647
USPC ..... 399/90, 91, 110, 111, 113, 114
See application file for complete search history.

(56) References Cited

U.S. PATENT DOCUMENTS

| | | | | |
|---|---|---|---|---|
| 8,583,006 | B2 | 11/2013 | Murayama et al. | |
| 2003/0123896 | A1* | 7/2003 | Goto et al. | 399/90 |
| 2005/0135831 | A1* | 6/2005 | Kawaguchi et al. | 399/90 |
| 2008/0159773 | A1 | 7/2008 | Murayama et al. | |
| 2010/0098457 | A1* | 4/2010 | Watanabe | 399/111 |
| 2011/0299885 | A1* | 12/2011 | Taba | 399/111 |
| 2012/0114374 | A1* | 5/2012 | Suzuki | 399/111 |
| 2012/0177403 | A1 | 7/2012 | Murayama et al. | |
| 2014/0169824 | A1* | 6/2014 | Seto et al. | 399/90 |

FOREIGN PATENT DOCUMENTS

JP 2008-165025 A 7/2008

* cited by examiner

*Primary Examiner* — Francis Gray
(74) *Attorney, Agent, or Firm* — Banner & Witcoff, Ltd.

(57) ABSTRACT

An image forming apparatus includes: a main casing provided with a main-body electrode; a cartridge; a supporting member for supporting the cartridge; and a first displacing mechanism. The cartridge includes a processing body elongated in a first direction and a power-receiving part capable of contacting the main-body electrode. The supporting member is movable between a first position inside the main casing and a second position outside the main casing in a second direction generally perpendicular to the first direction. The first displacing mechanism is configured to move the cartridge supported in the supporting member in the first direction from a non-contact position where the main-body electrode and the power-receiving part are separated from each other to a contact position where the main-body electrode and the power-receiving part are in contact with each other.

20 Claims, 10 Drawing Sheets

IMAGE FORMING APPARATUS HAVING MOVABLE SUPPORTING MEMBER FOR SUPPORTING CARTRIDGE

CROSS REFERENCE TO RELATED APPLICATION

This application claims priority from Japanese Patent Application No. 2013-074690 filed Mar. 29, 2013. The entire content of the priority application is incorporated herein by reference.

TECHNICAL FIELD

The present invention relates to an electro-photographic image forming apparatus.

BACKGROUND

A known tandem-type color printer includes a main body and a plurality of cartridges detachably mountable in the main body.

One of such conventional color printers includes a main body and a cartridge tray configured to be held in the main body so as to be slidable relative to the main body. In this color printer, the cartridge tray supports therein a plurality of cartridges juxtaposed to one another (see Japanese Patent Application Publication No. 2008-165025).

SUMMARY

It is an object of the present invention to provide an improved image forming apparatus.

In order to attain the above and other objects, there is provided an image forming apparatus including a main casing, a cartridge, a supporting member and a first displacing mechanism. The main casing is provided with a main-body electrode. The cartridge includes a processing body elongated in a first direction for image formation and a power-receiving part configured to contact the main-body electrode for receiving power therefrom and for supplying the power to the processing body. The supporting member is configured to support the cartridge therein, the supporting member being movable between a first position and a second position in a second direction generally perpendicular to the first direction, the supporting member at the first position being positioned outside the main casing and the supporting member at the second position being positioned inside the main casing. The first displacing mechanism is configured to move the cartridge supported in the supporting member from a non-contact position to a contact position in the first direction, the main-body electrode and the power-receiving part being separated from each other at the non-contact position of the cartridge, the main-body electrode and the power-receiving part being in contact with each other at the contact position of the cartridge.

According to another aspect of the present invention, there is provided an image forming apparatus including a main casing, a cartridge, a drawer and a first displacing mechanism. The main casing is provided with a main-body electrode. The cartridge includes a developing roller extending a first direction and a cartridge electrode configured to contact the main-body electrode and supply an electric power to the developing roller. The drawer is configured to support the cartridge, the drawer being movable between a first position and a second position in a second direction intersecting the first direction, the drawer at the first position being positioned outside the main casing and the drawer at the second position being positioned inside the main casing, the drawer being configured to move between a non-contact position and a contact position in the first direction, the main-body electrode and the cartridge electrode being separated from each other at the non-contact position of the drawer, the main-body electrode and the cartridge electrode being in contact with each other at the contact position of the drawer. The first displacing mechanism is configured to displace the drawer from the non-contact position to the contact position.

DETAILED DESCRIPTION

1. General Structure of the Printer

Figure 1:
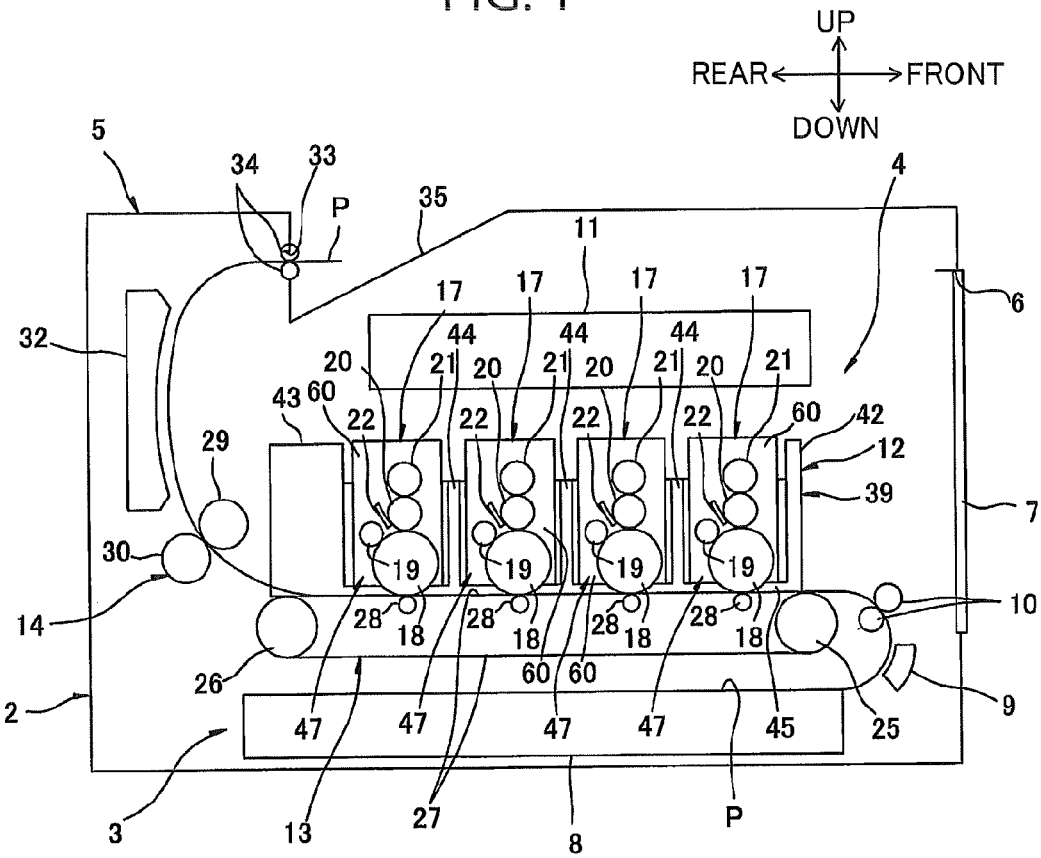
FIG. 1 is a schematic central cross-sectional view illustrating a general configuration of a printer according to a first embodiment of the present invention, wherein a drawer unit according to the first embodiment is accommodated in a main casing of the printer.

A printer 1 is a horizontal direct tandem-type color laser printer, as shown in FIG. 1. The printer 1 is an example of an image forming apparatus according to a first embodiment of the present invention.

First, a general structure of the printer 1 will be described with reference to FIG. 1.

Throughout the specification, the terms "above", "below", "right", "left", "front", "rear" and the like will be used assuming that the printer 1 is resting on a level surface. More specifically, in FIG. 1, a right side, a left side, a near side and a far side will be referred to as a front side, a rear side, a left side and a right side of the printer 1, respectively.

(1) Main Casing

The main casing 2 has a substantially rectangular box shape in a side view. The main casing 2 has a front wall formed with an opening 6, and a front cover 7. The front cover 7 is configured to be pivotally movable about a lower end portion thereof between a closing position closing the opening 6 (show by a solid line in FIG. 1) and an opening position opening the opening 6 (shown by a broken line in FIG. 1). The main casing 2 houses therein a sheet supply section 3 and an image forming section 4.

(2) Sheet Supply Section

The sheet supply section 3 has a sheet cassette 8, a sheet supply guide 9 and a pair of registration rollers 10. The sheet cassette 8 serves to accommodate sheets of paper P therein. The sheet cassette 8 is detachably attached to a bottom portion of the main casing 2.

The sheets P stacked in the sheet cassette 8 are fed one by one, and directed upward and rearward toward between the pair of registration rollers 10 while being guided along a U-shaped path by the sheet guide 9, and then conveyed at a prescribed timing toward between a photosensitive drum 18 (described later) and a conveying belt 27 (described later) of the image forming section 4.

(3) Image Forming Section

The image forming section 4 includes a scanner unit 11, a drawer unit 12, a transfer unit 13, and a fixing unit 14.

(3-1) Scanner Unit

The scanner unit 11 is disposed at an upper portion of the main casing 2. The scanner unit 11 emits a laser beam to each of a plurality of photosensitive drums 18 (described later) based on image data to expose the corresponding photosensitive drum 18 to light.

(3-2) Drawer Unit

The drawer unit 12 is disposed at a position generally center of the main casing 2 in an up-down direction and below the scanner unit 11.

The drawer unit 12 includes a drawer frame 39 and four process cartridges 17 corresponding to respective four colors used in the printer 1. The four process cartridges 17 are attachable to and detachable from the drawer frame 39.

The four process cartridges 17 are arranged spaced apart from one another in the front-rear direction in the drawer frame 39. The process cartridges 17 include a black process cartridge 17K, a yellow process cartridge 17Y, a magenta process cartridge 17M, and a cyan process cartridge 17C arranged in the drawer frame 39 in the mentioned order from the front to the rear.

Each of the four process cartridges 17 includes the photosensitive drum 18, a charging roller 19, a developing roller 20, a supply roller 21, and a thickness regulation blade 22.

The photosensitive drum 18 has a substantially cylindrical shape extending in a left-right direction. The photosensitive drum 18 is rotatably supported by a lower end portion of the process cartridge 17. A lower end portion of the photosensitive drum 18 is exposed downward from the process cartridge 17.

The charging roller 19 has a substantially columnar shape extending in the left-right direction. The charging roller 19 is rotatably supported in the process cartridge 17 to be in contact with an upper rear portion of the photosensitive drum 18.

The developing roller 20 has a substantially columnar shape extending in the left-right direction. The developing roller 20 is rotatably supported in the process cartridge 17 to be in contact with an upper portion of the photosensitive drum 18.

The supply roller 21 has a substantially columnar shape extending in the left-right direction. The supply roller 21 is rotatably supported in the process cartridge 17 to be in contact with an upper portion of the developing roller 20.

The thickness regulation blade 22 is rotatably supported in the process cartridge 17 to be in contact with a rear portion of the developing roller 20.

Each of the four process cartridge 17 houses toner of one of four colors in a space provided above the developing roller 20 and thickness regulation blades 22. That is, the toner within the process cartridge 17 is positioned in the vicinity of the supply roller 21.

The supply roller 21 supplies the toner in the process cartridge 17 to the developing roller 20. At this time, the toner is tribo-charged with a positive polarity between the supply roller 21 and developing roller 20.

Subsequently, as the developing roller 20 rotates, the toner on the developing roller 20 is regulated by the thickness regulation blade 22 and carried as a thin toner layer of a uniform thickness on a surface of the developing roller 20.

In the meantime, a surface of the photosensitive drum 18 is uniformly and positively charged by the charging roller 19 as the photosensitive drum 18 rotates. Then, the scanner unit 11 emits a laser beam to the charged surface of the photosensitive drum 18 to expose the surface of the photosensitive drum 18 to light. As a result, an electrostatic latent image corresponding to an image to be formed on the sheet P is formed on the surface of the photosensitive drum 18.

As the photosensitive drum 18 further rotates, the toner carried on the surface of the developing roller 20 and having a positive polarity is supplied to the electrostatic latent image formed on the surface of the photosensitive drum 18. In this way, a toner image is formed on the surface of the photosensitive drum 18 through a reversal phenomenon. In other words, the developing roller 20, supply roller 21, and charging roller 19 are used for image formation.

(3-3) Transfer Unit

In the main casing 2, the transfer unit 13 is disposed above the sheet supply section 3 but below the drawer unit 12 within the main casing 2. The transfer unit 13 extends in the front-rear direction.

The transfer unit 13 includes a drive roller 25, a driven roller 26, the conveying belt 27, and four transfer rollers 28.

The drive roller 25 and driven roller 26 are arranged to be spaced apart from each other in the front-rear direction. The conveying belt 27 is mounted on and around the drive roller 25 and driven roller 26 in a tout state. Each of the four transfer rollers 28 is disposed to correspond to the corresponding one of the four photosensitive drums 18 such that an upper portion of the conveying belt 27 is interposed between each of the pairs of the transfer roller 28 and the photosensitive drum 18. Each pair of the transfer roller 28 and the photosensitive drum 18 defines a transfer position therebetween on the conveying belt 27.

The sheet P supplied from the sheet supply section 3 is conveyed by the conveying belt 27 conveys from the front side to rear side to sequentially passes through the four transfer positions. During passage of the sheet P through the transfer positions, the toner images of the respective colors carried on the respective photosensitive drums 18 are sequentially superimposed onto the sheet P to form a color image thereon.

(3-4) Fixing Unit

The fixing unit 14 is disposed rearward of the transfer unit 13. The fixing unit 14 includes a heating roller 29 and a pressure roller 30. The pressure roller 30 is disposed at a lower rear side of the heating roller 29 and in contact with a lower rear portion of the heating roller 29.

As the sheet P passes between the heating roller 29 and pressure roller 30, the toner image transferred onto the sheet P is thermally fixed thereon due to application of heat and pressure by the heating roller 29 and pressure roller 30

(4) Sheet Discharge Section

The sheet discharge section 5 is disposed above the fixing unit 14. The sheet discharge section 5 includes a discharge guide 32, a discharge port 33, a pair of discharge rollers 34, and a discharge tray 35.

The sheet P on which the toner image has been thermally fixed in the fixing unit 14 is fed upward and frontward while making a U-turn with a guide by the discharge guide 32. The sheet P then passes between the pair of discharge rollers 34, and is finally discharged onto the discharge tray 35 through the discharge port 33.

2. Detailed Structure of the Drawer Unit

Figure 2:
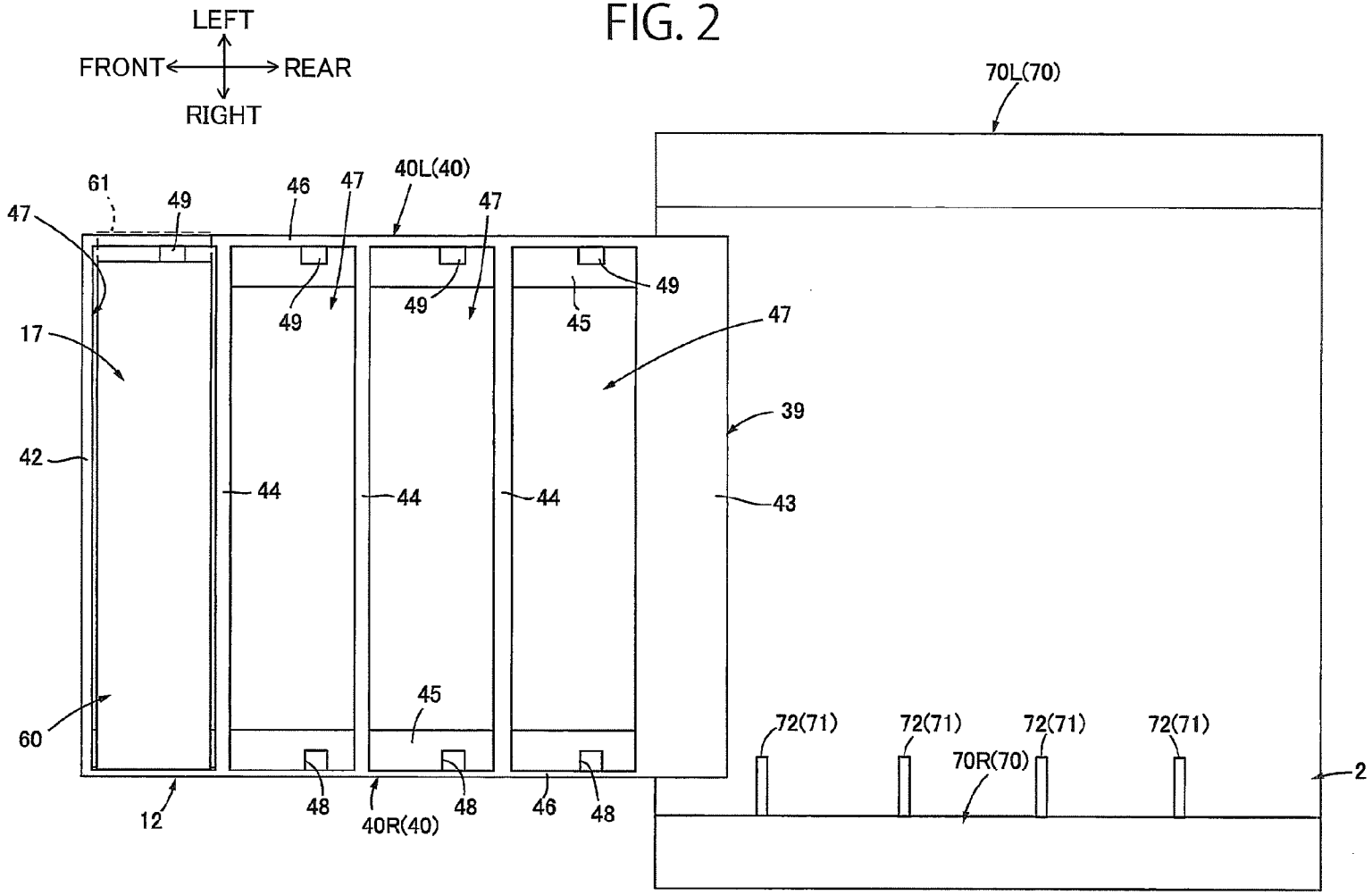
FIG. 2 is a plan view of the drawer unit and the main casing according to the first embodiment, wherein a drawer frame of the first embodiment is in a pulled-out position.
Figure 3A:
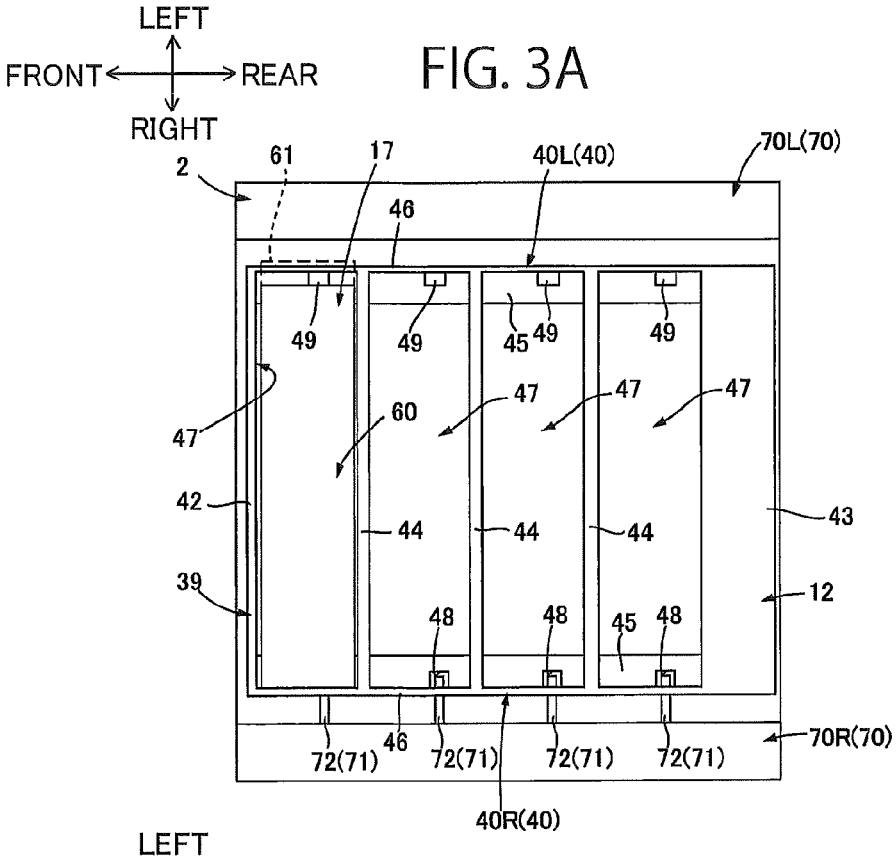
FIG. 3A is a plan view of the drawer unit and the main casing according to the first embodiment, wherein the drawer frame is in an intermediate position.
Figure 3B:
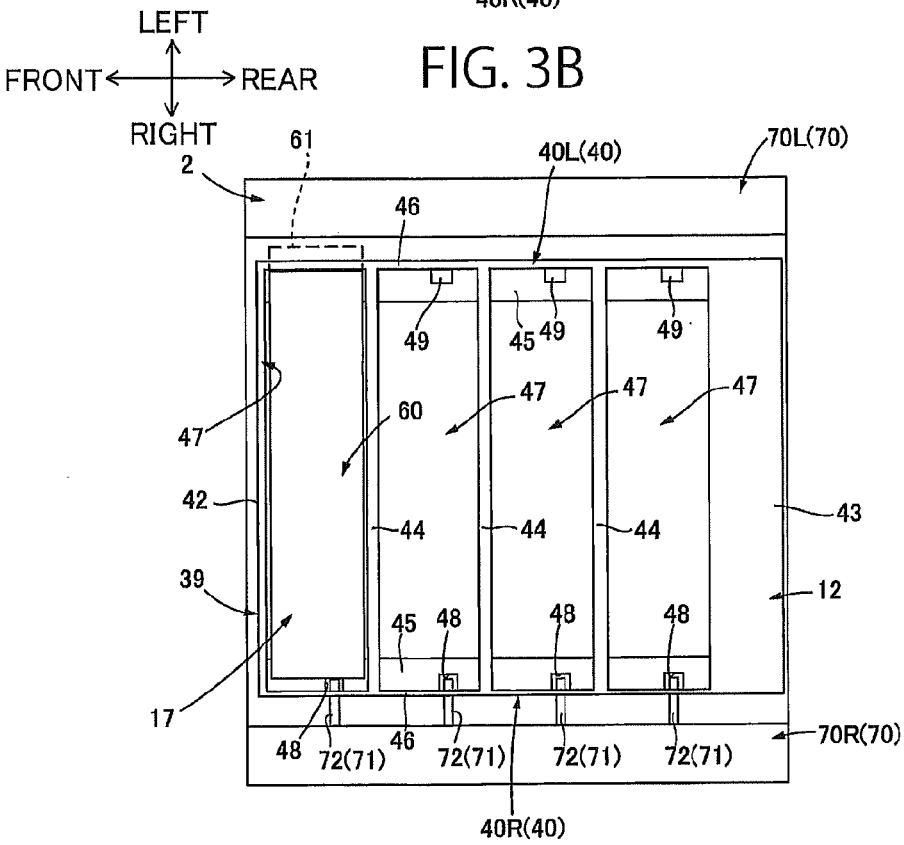
FIG. 3B is a plan view of the drawer unit and the main casing according to the first embodiment, wherein the drawer frame is in a mounted position.
Figure 4:
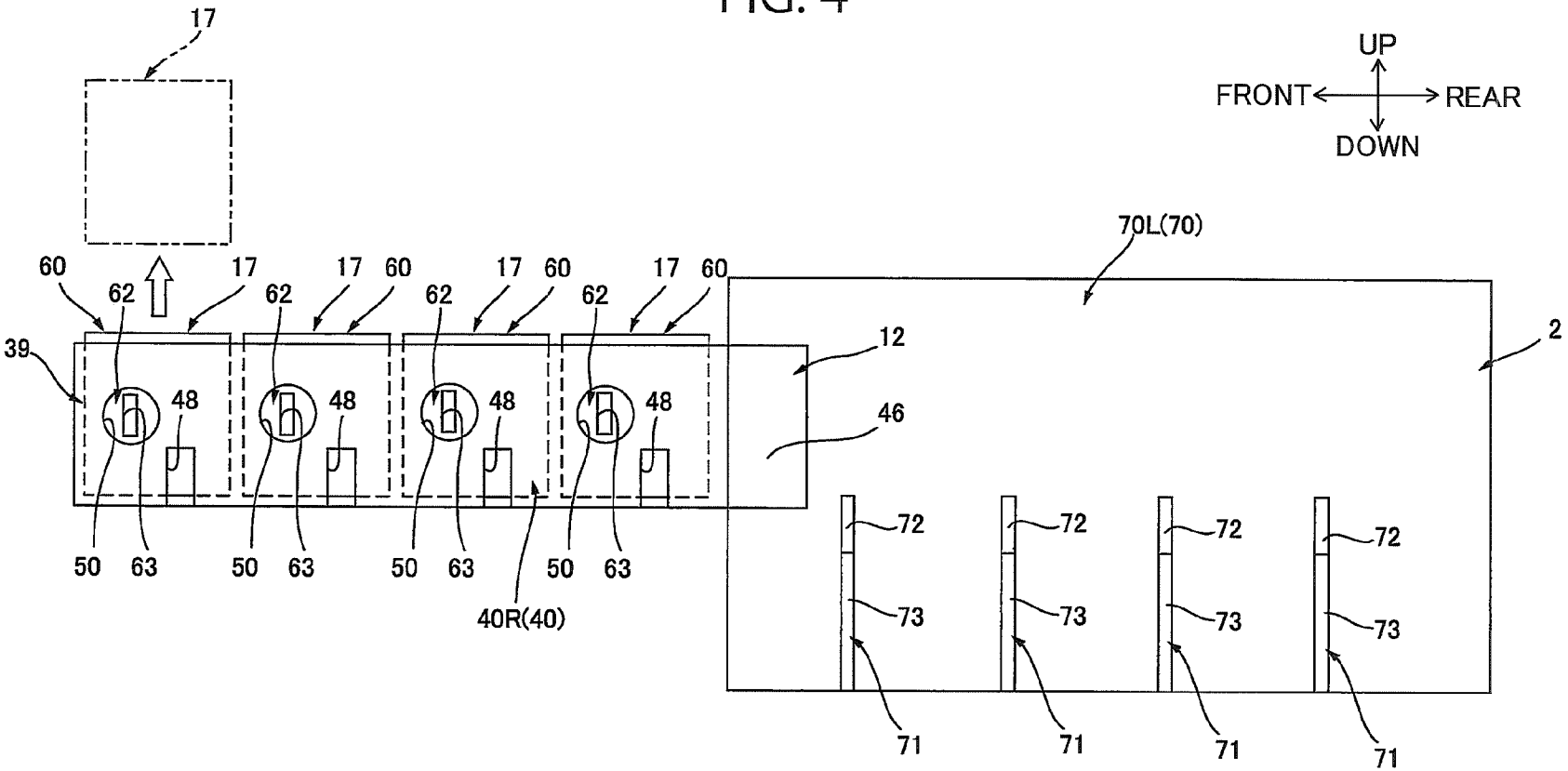
FIG. 4 is a right side view of the drawer unit and the main casing according to the first embodiment, the drawer frame is in the pulled-out position.

As illustrated in FIGS. 2 and 4, the drawer unit 12 includes the drawer frame 39 and the four process cartridges 17. For the sake of explanation purpose, only a frontmost process cartridge 17 among the four process cartridges 17 is illustrated in FIGS. 2 and 3.

(1) Drawer Frame

The drawer frame 39 is configured to move between a mounted position at which the drawer frame 39 is mounted in the main casing 2 (as illustrated in FIG. 1) and a pulled-out position at which the drawer 39 is pulled out from the main casing 2 (as illustrated in FIG. 4).

As illustrated in FIG. 2, the drawer frame 39 has a substantially rectangular frame shape in a plan view and includes a pair of side walls 40, a front wall 42, a rear wall 43, and partition walls 44.

The pair of side walls 40 is disposed away from each other in the left-right direction. Each of the pair of side walls 40 has an L-like shape in a front view as illustrated in FIG. 6A and extends in the front-rear direction as illustrated in FIG. 4.

Specifically, the side wall 40 includes a main part 46 and a cartridge support wall 45. The main part 46 has a substantially rectangular plate-like shape in a side view and extends in the front-rear direction, as shown in FIG. 4. The cartridge support wall 45 protrudes inward from a lower end portion of the main part 46 in the left-right direction, as illustrated in FIG. 6A. The cartridge support wall 45 has a substantially rectangular plate-like shape in a plan view and extends in the front-rear direction.

Hereinafter, the side wall 40 on the right is referred to as a right side wall 40R, and the side wall 40 on the left is referred to as a left side wall 40L, whenever necessary.

Figure 6A:
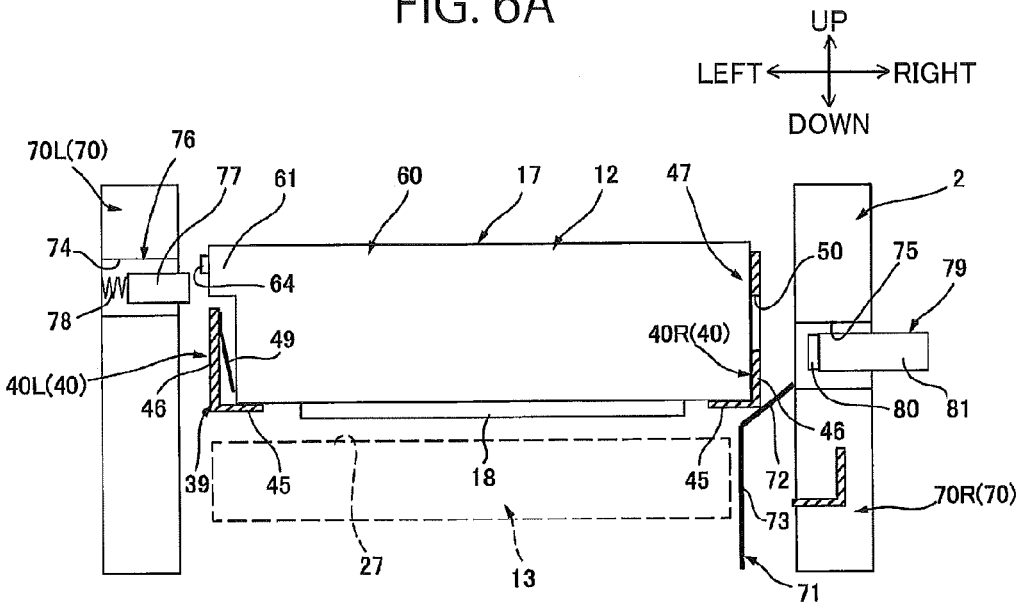
FIG. 6A is a front view of the drawer unit and the main casing according to the first embodiment, wherein the drawer frame is in the intermediate position.

As illustrated in FIG. 6A, the main part 46 of the left side wall 40L has a length (height) smaller than that of the main part 46 of the right side wall 40R in the up-down direction.

The front wall 42 has a substantially rectangular plate-like shape in a front view and extends in the left-right direction to connect front end portions of the pair of side walls 40.

The rear wall 43 has a substantially rectangular plate-like shape in a rear view and extends in the left-right direction to connect rear end portions of the pair of side walls 40.

Each of the partition walls 44 has a substantially rectangular plate-like shape in a front view and extends in the left-right direction 44. The three partition walls 44 are arranged in opposition to and in separation from one another in the front-rear direction to divide an inner space of the drawer frame 39 substantially equally in the front-rear direction. Left and right end portions of each partition wall 44 are connected to the left and right side walls 40L and 40R respectively.

Specifically, the three partition walls 44 are arranged to partition a space between the front wall 42 and rear wall 43 of the drawer frame 39 at substantially equal-intervals in the front-rear direction to provide four spaces arranged in the front-rear direction. That is, the inner space of the drawer frame 39 is partitioned into four spaces, each functioning as a space for housing each of the four process cartridges 17 (referred to as a "cartridge housing space 47" hereinafter).

More specifically, the front wall 42, the frontmost partition wall 44, and portions of both side walls 40 therebetween define a frontmost cartridge housing space 47. The frontmost partition wall 44, center partition wall 44, and portions of both side walls 40 therebetween define a second frontmost cartridge housing space 47. The center partition wall 44, the rearmost partition wall 44, and portions of both side walls 40 therebetween define a third frontmost cartridge housing space 47. The rearmost partition wall 44, rear wall 43, and portions of both side walls 40 therebetween define a rearmost cartridge housing space 47.

Further, as illustrated in FIG. 4, the right side wall 40R is formed with four through-holes 50 and four openings 48.

The through-holes 50 are formed to correspond to the cartridge housing spaces 47 respectively. More specifically, the four through-holes 50 are formed in the main part 46 of the right side wall 40R to be spaced apart from one another in the front-rear direction. Each through-hole 50 has a substantially circular shape and penetrates the main part 46 in the left-right direction.

Each of the cartridge housing spaces 47 are thus in communication with outside of the drawer frame 39 through corresponding one of the through-holes 50.

The four openings 48 are also positioned to correspond to the four cartridge housing spaces 47, respectively. More specifically, in the right side wall 40R, the openings 48 are formed to be aligned and spaced apart from one another in the front-rear direction, each at a position downward and rearward of each through-hole 50.

Each opening 48 is open on the lower end portion of the main part 46 and on a right end portion of the cartridge support wall 45 to permit a guide portion 72 of an abutting member 71 (described later) to pass through the opening 48. More specifically, each opening 48 penetrates the lower end portion of the main part 46 in the left-right direction as well as the right end portion of the cartridge support wall 45 in the up-down direction. Hence, each cartridge housing space 47 is in communication with outside of the drawer frame 39 through corresponding one of the openings 48.

Further, as illustrated in FIG. 2, the drawer frame 39 includes four biasing members 49.

The four biasing members 49 are provided to correspond to the four cartridge housing spaces 47, respectively.

Specifically, each biasing member 49 is disposed within the corresponding cartridge housing space 47 at a position rightward of and adjacent to the main part 46 of the left side wall 40L. The biasing members 49 are thus aligned and spaced apart from one another in the front-rear direction.

As illustrated in FIG. 6A, the biasing members 49 are formed as a leaf spring (a resilient member). Each biasing member 49 has an upper portion extending in the front-rear direction and a lower portion extending diagonally downward and rightward from a bottom end of the upper portion. The upper portion of each biasing member 49 is fixed to a right surface of the main part 46 of the left side wall 40L, and the lower portion of each biasing member 49 has a distal end that is positioned above an upper surface of the corresponding cartridge support wall 45 of the left side wall 40L in the up-down direction.

(2) Process Cartridge

As illustrated in FIG. 4, the process cartridges 17 are detachably accommodated in the corresponding cartridge housing spaces 47, respectively. As illustrated in FIG. 6A, lower end portions of the process cartridges 17 are in abutment with the upper surfaces of the cartridge support walls 45 of the left and right side walls 40L and 40R, whereby the drawer frame 39 supports the process cartridges 17.

Each process cartridge 17 includes a casing 60 of substantially box-like shape, as shown in FIG. 1. The casing 60 has a lower end that is open downward. The lower end portion of the photosensitive drum 18 is exposed through the open lower end of the casing 60, as illustrated in FIG. 6A. The casing 60 has a dimension smaller than a distance between the main parts 46 of the left and right side walls 40L and 40R in the left-right direction. Thus, the process cartridges 17 are movable with respect to the left-right direction while being accommodated in the corresponding cartridge housing spaces 47.

The casing 60 has a left side wall on which an electrode retaining part 61 is provided. The electrode retaining part 61 has a substantially rectangular columnar shape extending in the left-right direction and protrudes leftward from an upper portion of a left surface of the casing 60.

The electrode retaining part 61 includes an electrode contact 64. The electrode contact 64 has a substantially rectangular columnar shape extending in the left-right direction and protrudes leftward from a general center of a left surface of the electrode retaining part 61. Although not illustrated, the electrode contact 64 is electrically connected to an internal configuration of the casing 60 such that the electrode contact 64 is configured to receive electric power from an electrode unit 76 (described later) of the main casing 2 and to supply the received electric power to the photosensitive drum 18, charging roller 19, developing roller 20, and supply roller 21.

Further, the casing 60 has a right side wall in which a cartridge coupling 62 is disposed, as illustrated in FIG. 4.

The cartridge coupling 62 is substantially circular disk-like shaped in a side view and is disposed at a substantial center of a front portion of the right side wall of the casing 60. The cartridge coupling 62 has a center portion in which a concave portion 63 is formed. The concave portion 63 has a substantially rectangular shape in a side view and extends in a radial direction of the cartridge coupling 62. The concave portion 63 is depressed leftward from a right surface of the cartridge coupling 62.

The cartridge coupling 62 is exposed rightward through the corresponding through-hole 50 of the right side wall 40R when the process cartridge 17 is housed in the corresponding cartridge housing space 47.

Although not illustrated, the cartridge coupling 62 is connected to a gear train so as to receive drive force from a main-body coupling 79 (described later) and to transmit the drive force to the photosensitive drum 18, charging roller 19, developing roller 20, and supply roller 21.

As illustrated in FIG. 6A, when the process cartridge 17 is housed in the corresponding cartridge housing space 47, the casing 60 is biased rightward by the biasing member 49 such that the process cartridge 17 is normally placed in a retracted position at which the process cartridge 17 is displaced rightward within the cartridge housing space 47.

When the process cartridge 17 is in the retracted position, the left surface of the electrode retaining part 61 of the casing 60 is substantially flush with a left surface of the left side wall 40L of the drawer frame 39, as illustrated by a broken line in FIG. 2. In other words, when the process cartridge 17 is in the retracted position, the electrode contact 64 cannot contact the corresponding electrode unit 76.

3. Detailed Structure of the Main Casing

As illustrated in FIG. 6A, the main casing 2 has a pair of main-body side walls 70, four electrode units 76, four main-body couplings 79, and four abutting members 71.

The pair of main-body side walls 70 includes a left main-body side wall 70L and a right main-body side wall 70R disposed in opposition to and in separation from each other in the left-right direction.

The left main-body side wall 70L includes four electrode insertion holes 74. The electrode insertion holes 74 are positioned to correspond to the electrode contacts 64 of the process cartridges 17, respectively. More specifically, the four electrode insertion holes 74 are arranged to be spaced away from one another in the front-rear direction and formed in an upper portion of the left main-body side wall 70L to penetrate therethrough in the left-right direction.

The right main-body side wall 70R includes four coupling insertion holes 75. The coupling insertion holes 75 are positioned to correspond to the cartridge couplings 62 of the process cartridges 17, respectively. More specifically, the four coupling insertion holes 75 are arranged to be spaced away from one another in the front-rear direction and formed in a substantially vertical center of the right main-body side wall 70R to penetrate therethrough in the left-right direction.

The four electrode units 76 are provided to correspond to the electrode insertion holes 74 of the left main-body side wall 70L. Specifically, the electrode units 76 are disposed within the respective electrode insertion holes 74. Although not illustrated, the electrode units 76 are electrically connected to a power source provided in the main casing 2.

Each electrode unit 76 includes a spring member 78 and a main-body contact 77.

The spring member 78 is an air-cored coil shaped and extends in the left-right direction. The spring member 78 has a left end fixed to the left main-body side wall 70L so as not to move relative to the same.

The main-body contact 77 has a substantially columnar shape extending in the left-right direction. The main-body contact 77 has a left end fixed to a right end of the spring member 78. With this configuration, the main-body contact 77 is movable in the left-right direction and is normally biased rightward by the spring member 78.

The four main-body couplings 79 are provided to correspond to the coupling insertion holes 75 of the right main-body side wall 70R. Specifically, the main-body coupling 79 are disposed within the respective coupling insertion holes 75.

The main-body coupling 79 has a columnar portion 81 and a convex portion 80. The columnar portion 81 has a substantially columnar shape extending in the left-right direction. The convex portion 80 is so configured as to be insertable into the concave portion 63 of the cartridge coupling 62. The convex portion 80 protrudes leftward from a left end face of the columnar portion 81.

The main-body coupling 79 is configured to move between a non-transmission position (indicated by a solid line in FIG. 6B) at which the convex portion 80 is disposed within the coupling insertion hole 75 and a transmission position (indicated by a broken line in FIG. 6B) at which the convex portion 80 is positioned leftward of the right main-body side wall 70R. The main-body coupling 79 is configured to receive drive force from a drive source (not shown) such as a motor provided in the main casing 2. The main-body coupling 79 is thus rotatable upon receipt of the drive force.

As illustrated in FIG. 2, the four abutting members 71 are provided to correspond to the four process cartridges 17, respectively. Each abutting member 71 is disposed leftward of and adjacent to a lower portion of the right main-body side wall 70R (see FIG. 6A) such that each abutting member 71 is positioned rearward of and downward of each coupling insertion hole 75 in a left side view.

Specifically, the abutting member 71 includes a fixing portion 73 and a guide portion 72, as shown in FIG. 6A. The fixing portion 73 has a substantially rectangular columnar shape and extends vertically in the up-down direction. The fixing portion 73 has a lower end that is fixed to a bottom portion of the main casing 2. The guide portion 72 extends diagonally upward and rightward from an upper end of the fixing portion 73. The guide portion 72 has an upper end that is fixed to a left surface of the right main-body side wall 70R.

The main casing 2 further includes an ascend/descend mechanism 15 with a well-known structure.

The ascend/descend mechanism 15 is in interlocking relation with opening and closing of the front cover 7. Specifically, as the front cover 7 moves between the closing position and opening position, the ascend/descend mechanism 15 causes the drawer frame 39 to move generally in the up-down direction between the mounted position where each photosensitive drum 18 is in contact with the conveying belt 27 (FIG. 6B) and an intermediate position where each photosensitive drum 18 is separated from the conveying belt 27 (FIG. 6A). In other words, the ascend/descend mechanism 15 is configured to move the drawer frame 39 supporting the process cartridges 17 between the mounted position and intermediate position in the up-down direction in conjunction with closing and opening of the front cover 7.

Further, when the front cover 7 is at the opening position, the ascend/descend mechanism 15 is configured to guide the movement of the drawer frame 39 between the intermediate position (FIG. 6A) and pulled-out position (FIG. 4) in a state where the photosensitive drums 18 are separated from the conveying belt 27.

4. Attachment and Detachment of the Process Cartridge (1) Attachment of the Process Cartridge to the Main Casing For attaching the process cartridge 17 to main casing 2, first the front cover 7 is placed at the opening position, and the drawer frame 39 is displaced to the pulled-out position as illustrated in FIG. 4.

Then, the process cartridges 17 are inserted from above into the respective cartridge housing spaces 47 of the drawer frame 39 at the pulled-out position.

(1-1) Movement of the Drawer Frame from the Pulled-Out Position to the Mounted Position Subsequently, the drawer frame 39 is pushed rearward from the pulled-out position. The ascend/descend mechanism 15 guides the rearward movement of the drawer frame 39. While the drawer frame 39 moves, each photosensitive drum 18 is kept separated from the conveying belt 27 (refer to FIG. 6A).

Incidentally, in this state, the process cartridges 17 supported by the drawer frame 39 are placed at the retracted position due to the corresponding biasing members 49. Thus, the electrode contacts 64 of the process cartridges 17 are spaced away from the corresponding main-body contacts 77 of the electrode units 76 in the left-right direction. At this time, the electrode contact 64 and main-body contact 77 are not aligned with each other (offset from each other) in the left-right direction (refer to FIG. 6A).

Figure 5A:
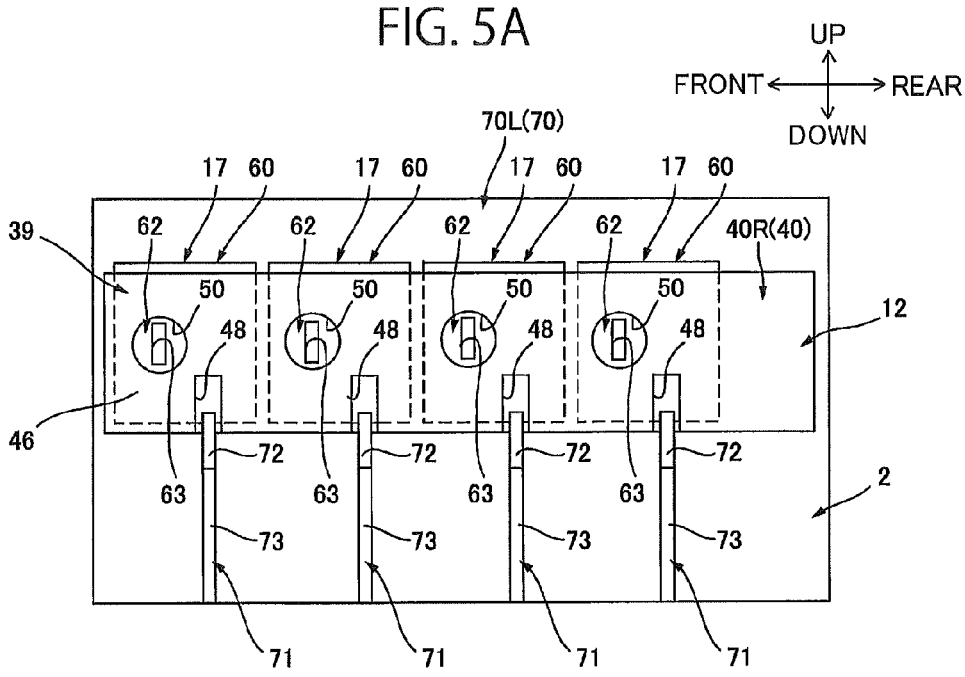
FIG. 5A is a right side view of the drawer unit and the main casing according to the first embodiment, wherein the drawer frame is in the intermediate position.

The drawer frame 39 is moved further rearward and reaches the intermediate position. In the intermediate position, as shown in FIG. 5A, the drawer frame 39 is accommodated in the main casing 2 and each opening 48 is positioned above the guide portion 72 of the corresponding abutting member 71.

That is, when the drawer frame 39 is in the intermediate position, the photosensitive drum 18 of each process cartridge 17 supported by the drawer frame 39 is disposed above the conveying belt 27 of the transfer unit 13 to be separated therefrom, and each opening 48 of the right side wall 40R is spaced away from the corresponding guide portion 72 of the abutting member 71 in the up-down direction.

Subsequently, the front cover 7 is moved from the opening position to the closing position.

In association with closing of the front cover 7, the drawer frame 39 is moved downward from the intermediate position by the ascend/descend mechanism 15.

Figure 5B:
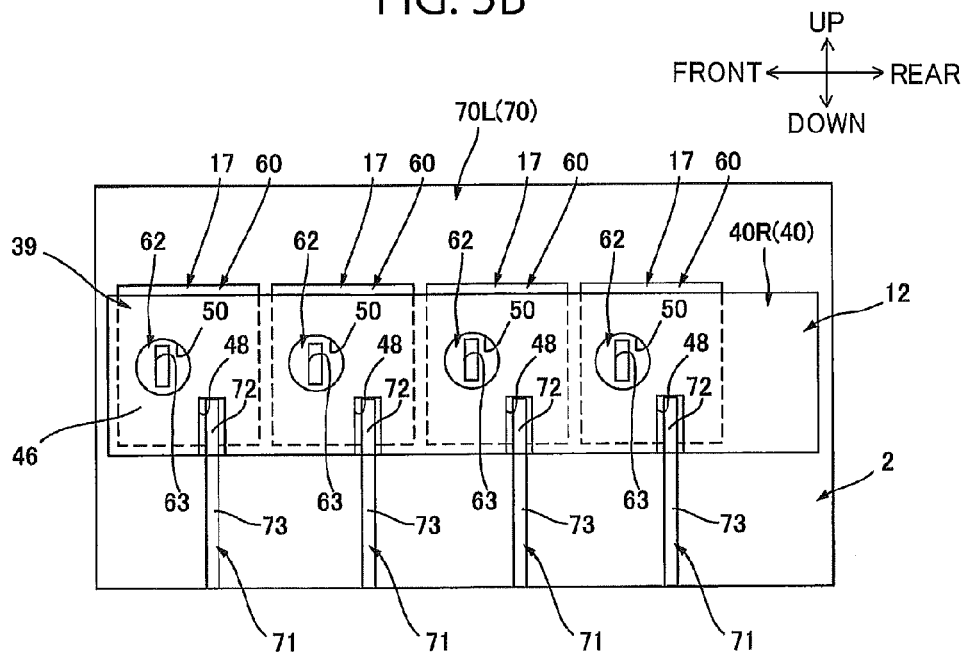
FIG. 5B is a right side view of the drawer unit and the main casing according to the first embodiment, wherein the drawer frame is in the mounted position.
Figure 6B:
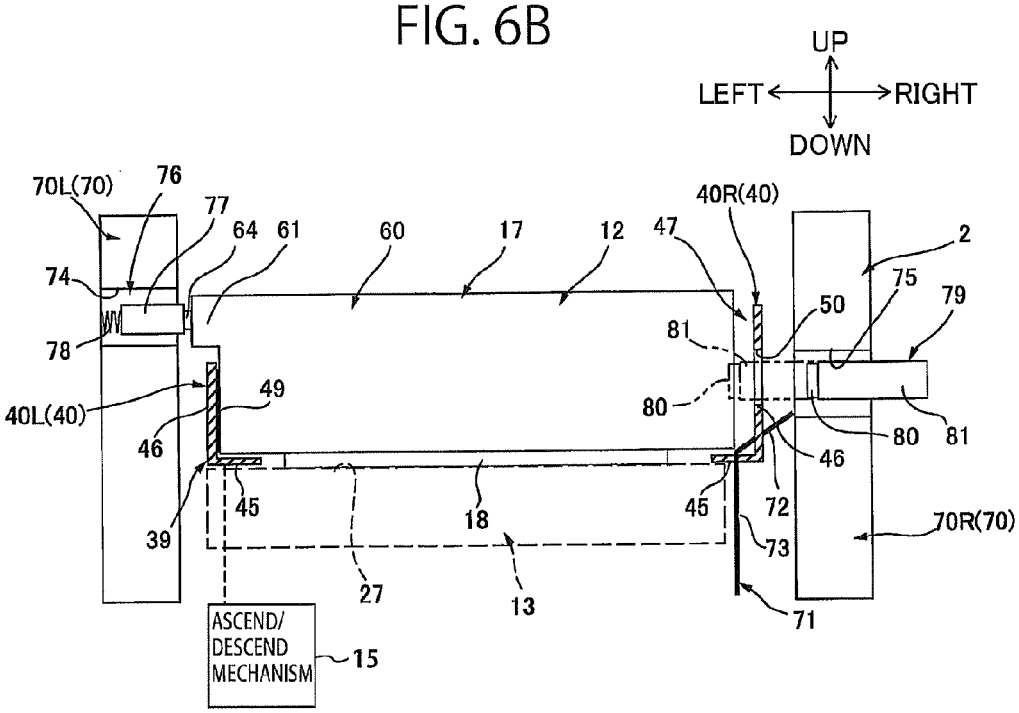
FIG. 6B is a front view of the drawer unit and the main casing according to the first embodiment, wherein the drawer frame is in the mounted position.

Then, as illustrated in FIGS. 5B and 6B, the guide portion 72 of the abutting member 71 starts to enter the opening 48 of the drawer frame 39 and is received within the same. A lower right end portion (lower-right corner portion) of the process cartridge 17 supported by the drawer frame 39 thus abuts on the guide portion 72 of the abutting member 71 from above through the opening 48, as illustrated in FIG. 6B.

As the drawer frame 39 moves downward, the process cartridge 17 is guided by the slope of the guide portion 72. Accordingly, due to the abutment with the abutting member 71, the process cartridge 17 is gradually moved leftward from the retracted position (shown in FIG. 6A) against the biasing force of the biasing member 49.

As the drawer frame 39 moves further downward and reaches the mounted position, each photosensitive drum 18 is brought into contact with the conveying belt 27. At this time, each through-hole 50 of the drawer frame 39 is placed leftward of the corresponding main-body coupling 79, and the cartridge coupling 62 of each process cartridge 17 is positioned to oppose the corresponding main-body coupling 79 in the left-right direction through the corresponding through-hole 50.

Incidentally, when the drawer frame 39 is in the mounted position, the guide of the process cartridge 17 by the guide portion 72 is completed, and the lower right end portion of the process cartridge 17 is in contact with a bent portion of the abutting member 71, the bent portion being a portion at which the guide portion 72 and fixing portion 73 are connected to each other. The process cartridge 17 is thus displaced leftward in the drawer frame 39 to be placed at an advanced position (shown in FIG. 6B).

In this state, the electrode retaining part 61 of the casing 60 protrudes leftward from the left side wall 40L, and the electrode contact 64 is brought into contact with a right end portion of the main-body contact 77. As a result, the electrode unit 76 and electrode contact 64 are electrically connected to each other, thereby enabling electric power from the power source (not shown) to be supplied to the photosensitive drum 18, charging roller 19, developing roller 20, and supply roller 21 via the electrode unit 76 and electrode contact 64. In other words, when the process cartridge 17 is in the advanced position, the electrode contact 64 and the electrode unit 76 are in contact with each other.

That is, while the drawer frame 39 supporting the process cartridge 17 moves from the intermediate position to the mounted position, the abutting member 71 moves the process cartridge 17, relative to the drawer frame 39, from the retracted position to the advanced position in the left-right direction.

With the above operation, the attachment of the process cartridge 17 to the main casing 2 is completed.

Incidentally, as illustrated in FIG. 6B, the main-body coupling 79 moves from the non-transmission position to the transmission position after the drawer frame 39 is placed in the mounted position. Then, although not illustrated, the convex portion 80 of the main-body coupling 79 is fittingly engaged with the concave portion 63 of the corresponding cartridge coupling 62 so as not to rotate relative to each other. With this structure, drive force from the drive source (not shown) can be inputted to the photosensitive drum 18, charging roller 19, developing roller 20, and supply roller 21 through the main-body coupling 79 and cartridge coupling 62.

(2) Detachment of the Process Cartridge from the Main Casing

For detaching the process cartridge 17 from the main casing 2, the above-described operation is performed in reverse.

Specifically, the front cover 7 is moved from the closing position to opening position. In association with the opening of the front cover 7, the ascend/descend mechanism 15 moves the drawer frame 39 upward from the mounted position to intermediate position, as illustrated in FIGS. 6A and 6B.

At this time, the abutment between the process cartridge 17 and abutting member 71 is released. As a result, the process cartridge 17 is moved rightward from the advanced position due to the biasing force of the biasing member 49, and is displaced to the retracted position. In other words, the biasing member 49 moves the process cartridge 17 from the advanced position to the retracted position while the drawer frame 39 supporting the process cartridge 17 moves from the mounted position to the intermediate position.

Accordingly, the contact between the electrode contact 64 of the process cartridge 17 and main-body contact 77 is released and the electrode contact 64 and main-body contact 77 are separated from each other in the left-right direction.

Subsequently, the drawer frame in the intermediate position is pulled out frontward as illustrated in FIG. 4.

The drawer frame 39 is pulled out from the intermediate position until all the process cartridges 17 are exposed from above and placed at the pulled-out position, as illustrated in FIG. 4. During the displacement of the drawer frame 39 from the intermediate position to the pulled-out position, each photosensitive drum 18 is kept separated from the conveying belt 27 in the up-down direction, as shown in FIG. 6A, by the ascend/descend mechanism 15.

Further, while the drawer frame 39 moves from the intermediate position to the pulled-out position, each electrode contact 64 passes upward and rightward of the corresponding main-body contact 77.

Subsequently, each process cartridge 17 housed in each cartridge housing space 47 is lifted upward to be detached from the drawer frame 39, as shown by the broken line in FIG. 4.

The detachment of the process cartridge 17 from the main casing 2 is thus completed.

5. Operational and Technical Advantages (1) As illustrated in FIGS. 6A and 6B, in the printer 1 of the first embodiment, the process cartridge 17 is configured to move in the left-right direction to be displaced from the retracted position to the advanced position. This structure realizes contact and separation of the electrode contact 64 relative to the electrode unit 76. Thus, the electrode unit 76 can be simply configured.

If the electrode unit 76 is fixed in position, the electrode contact 64 may be brought into contact with or separation from the electrode units 76 simply by the movement of the process cartridge 17. Thus, a mechanism for advancing and retracting the electrode unit 76 can be dispensed with. As a result, the electrode unit 76 can be simply configured and the printer 1 can be made compact.

(2) Further, the main casing 2 is provided with the conveying belt 27, and the process cartridge 17 has the photosensitive drum 18 configured to contact the conveying belt 27. In the main casing 2, the drawer frame 39 is configured to move in the substantially up-down direction between the intermediate position at which each photosensitive drum 18 does not contact the conveying belt 27 and the mounted position at which each photosensitive drum 18 contacts the conveying belt 27. In a state where the process cartridges 17 are supported by the drawer frame 39, the abutting members 71 moves the process cartridges 17 to the advanced position during displacement of the drawer frame 39 from the intermediate position to the mounted position.

With this configuration, the process cartridges 17 is moved to the advanced position while the drawer frame 39 moves from the intermediate position to the mounted position. This means that, while the drawer frame 39 moves from the pulled-out position to the mounted position, the process cartridge 17 can be placed at the retracted position so that contact between the electrode unit 76 and electrode contact 64 can be prevented.

Thus, sliding contact between the main-body contact 77 of the electrode unit 76 and the electrode contact 64 of the electrode retaining part can be suppressed while the drawer frame 39 moves between the pulled-out position and mounted position, thereby restraining occurrence of attrition resulting from the sliding contact.

(3) The abutting members 71 are configured to move the process cartridges 17 from the retracted position to advanced position relative to the drawer frame 39.

With this configuration, the abutting member 71 causes displacement of the process cartridge 17 from the retracted position to the advanced position, the electrode contact 64 can be brought into contact with the main-body contact 77 of the electrode unit 76 to establish electrical connection therebetween.

(4) Further, the abutting member 71 is configured to move the process cartridge 17 from the retracted position (FIG. 6A) to the advanced position (FIG. 6B) while the drawer frame 39 moves from the intermediate position (FIG. 6A) to the mounted position (FIG. 6B).

With this structure, contact between the main-body contact 77 of the electrode unit 76 and the electrode contact 64 can be reliably achieved.

(5) The main casing 2 has the abutting member 71 that can abut against the process cartridge 17.

With this configuration, as illustrated in FIGS. 6A and 6B, since the process cartridge 17 is moved from the retracted position to the advanced position by abutment thereof against the abutting member 71, the process cartridge 17 can be reliably moved from the retracted position to the advanced position.

(6) Further, in the printer 1, the biasing member 49 is provided for moving the corresponding process cartridge 17 from the advanced position to the retracted position while the drawer frame 39 supporting the process cartridge 17 moves from the mounted position to the intermediate position.

With this configuration, since the biasing member 49 moves the process cartridge 17 from the advanced position to the retracted position while the drawer frame 39 moves from the mounted position to the intermediate position, sliding contact between the main-body contact 77 of the electrode unit 76 and the electrode contact 64 can be prevented while the drawer frame 39 is moved from the intermediate position to the pulled-out position.

(7) Further, the biasing member 49 is provided in the drawer frame 39 and is configured to move the corresponding process cartridge 17 from the advanced position to the retracted position during displacement of the drawer frame 39 supporting the process cartridge 17 from the mounted position (FIG. 6B) to the intermediate position (FIG. 6A).

With the above configuration, the main casing 2 can be simple as the biasing member 49 is disposed on the drawer frame 39.

(8) Further, the biasing member 49 is formed by a leaf spring having a resiliency.

With the above configuration, the process cartridge 17 can be moved from the advanced position to the retracted position reliably even with a simple configuration.

6. Second Embodiment

Next, a detailed construction of a drawer unit 112 according to a second embodiment of the present invention will be described with reference to FIGS. 7A and 7B. In the following description, like parts and components are designated by the same reference numerals with those of the first embodiment to avoid duplicating description.

The drawer unit 112 includes a drawer frame 139 and four process cartridges 117 detachably supported in the drawer frame 139.

In the drawer unit 12 of the first embodiment, the drawer frame 39 is formed with the openings 48 for permitting the abutting members 71 to pass therethrough, as shown in FIG. 2. Further, the process cartridges 17 are housed in the respective cartridge housing spaces 47 such that each process cartridge 17 is movable in the left-right direction relative to the drawer frame 39.

Figure 7A:
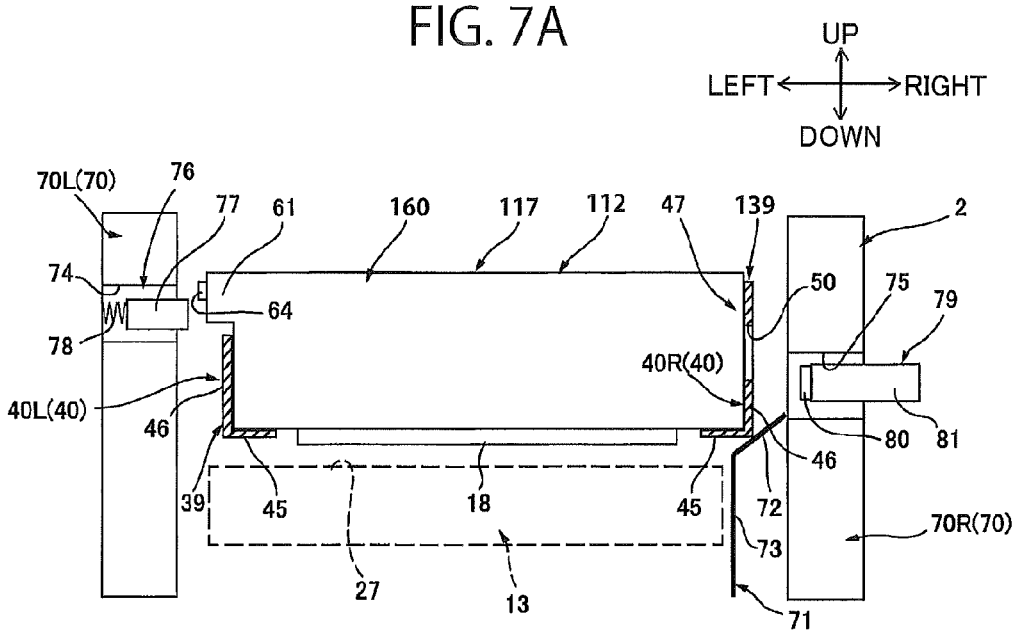
FIG. 7A is a front view of a drawer unit and a main casing according to a second embodiment of the present invention, wherein a drawer frame according to the second embodiment is in the intermediate position.
Figure 7B:
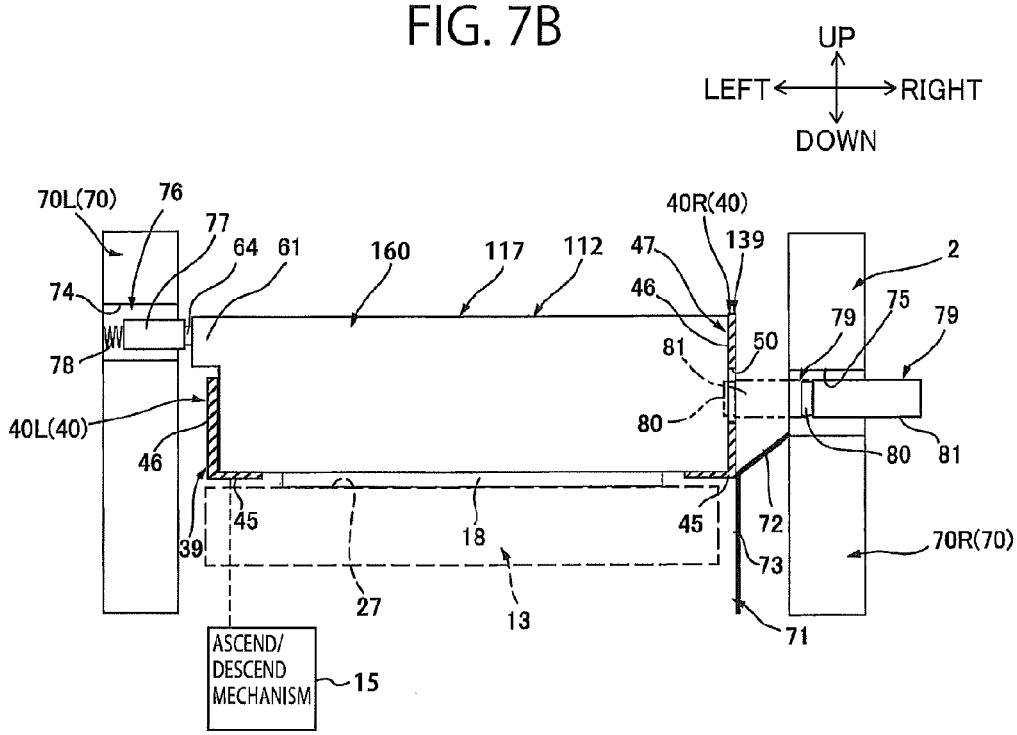
FIG. 7B is a front view of the drawer unit and the main casing according to the second embodiment, wherein the drawer frame is in the mounted position.

In contrast thereto, the drawer frame 139 of the second embodiment does not have the openings 48, and the process cartridges 117 are housed in the cartridge housing spaces 47 so as not to move relative to the drawer frame 139, as illustrated in FIGS. 7A and 7B.

Specifically, the process cartridge 117 of the second embodiment has a casing 160 whose dimension is substantially equal to the distance between the pair of side walls 40. The drawer frame 139 does not include the biasing members 49, unlike the drawer frame 39 of the first embodiment.

In the second embodiment, a lower right end portion of the drawer frame 139 abuts on the guide portions 72 of the four abutting members 71 when the drawer frame 139 is moved from the intermediate position (FIG. 7A) to the mounted position (FIG. 7B) due to the ascend/descend mechanism 15. When the drawer frame 139 is in the intermediate position, each process cartridge 17 is positioned upper right of the electrode units 76 to be spaced away therefrom. Thus, the electrode contact 64 and main-body contact 77 do not contact each other. This position of the process cartridge 17 corresponds to the "retracted position" in the second embodiment.

Then the drawer frame 139 is moved leftward by the guide of the guide member 72 while the drawer frame 139 is being moved from the intermediate position to the mounted position. When the drawer frame 139 reaches the mounted position, the lower right end portion of the drawer frame 139 contacts the bent portion of the abutting member 71 (the portion at which the guide portion 72 and fixing portion 73 are connected to each other).

In this state, the electrode contact 64 of the process cartridge 117 is in contact with the right end portion of the main-body contact 77. The process cartridge 117 is located at the advanced position, as shown in FIG. 7B.

That is, the abutting member 71 moves the process cartridge 117 from the retracted position (FIG. 7A) to the advanced position (7B) while accompanying movement of the drawer frame 139 in the up-down direction from the intermediate position to the mounted position.

This structure can serve to reduce occurrence of backlash between the drawer frame 139 and process cartridges 117, as compared to a configuration in which the process cartridge 117 moves relative to the drawer frame 139. This construction of the second embodiment can therefore ensure reliable contact between the electrode contact 64 of the process cartridge 117 and main-body contact 77 of the electrode unit 76.

Further, the depicted structure of the second embodiment can obtain the similar operational and technical advantages as those of the first embodiment.

Incidentally, a plurality of (four) abutting members 71 is provided in the second embodiment. However, alternatively, only one abutting member 71 may be provided.

7. Third Embodiment

Next, a detailed construction of a drawer unit 212 according to a third embodiment of the present invention will be described with reference to FIGS. 8A to 10B. In the following description, like parts and components are designated by the same reference numerals with those of the first embodiment to avoid duplicating description.

The drawer unit 212 of the third embodiment includes a drawer frame 239 and four process cartridges 217 detachably supported in the drawer frame 239.

In the drawer unit 12 of the first embodiment, the drawer frame 39 is provided with the biasing members 49, and the main casing 2 is provided with the abutting members 71.

Figure 10A:
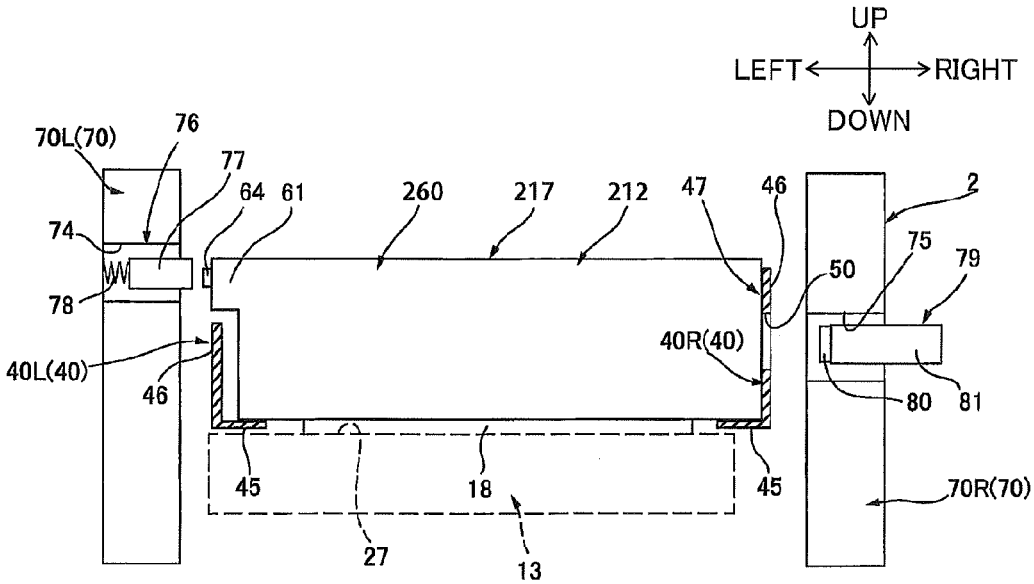
FIG. 10A is a front view of the drawer unit and the main casing according to the third embodiment, wherein a process cartridge of the third embodiment is in a retracted position.

In contrast, in the drawer unit 212 of the third embodiment, the drawer frame 239 does not have the biasing members 49. Further, the abutting members 71 are not provided in the main casing 2, as illustrated in FIG. 10A.

Figure 8A:
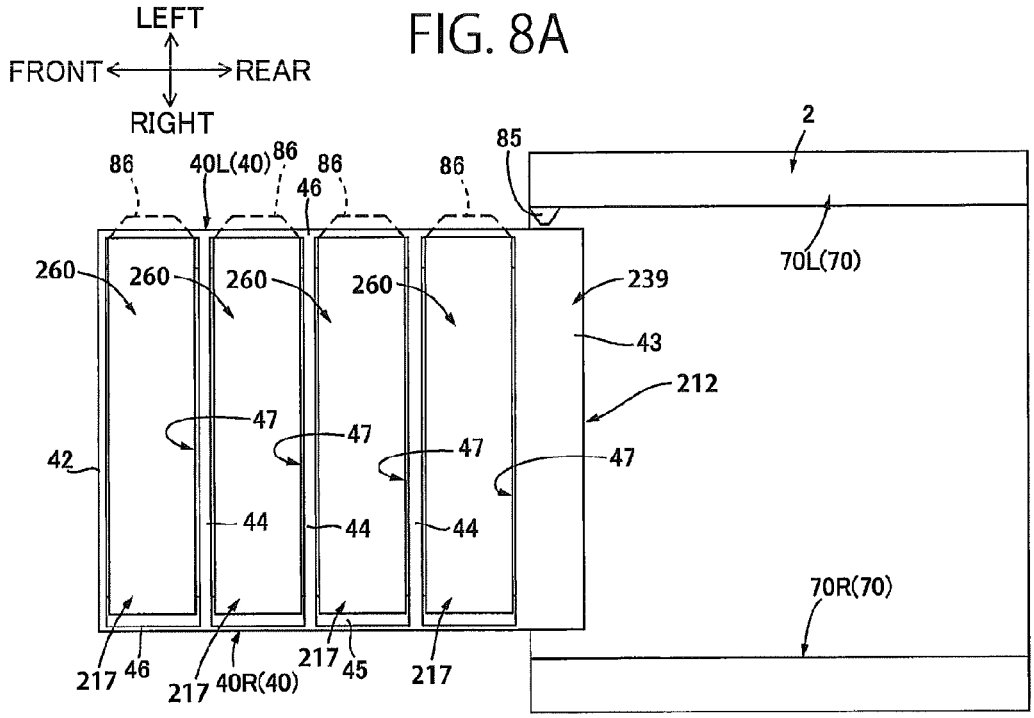
FIG. 8A is a plan view of a drawer unit and a main casing according to a third embodiment of the present invention, wherein a drawer frame according to the third embodiment is in the pulled-out position.

Specifically, in the third embodiment, the main casing 2 is provided with a protrusion 85, as shown in FIG. 8A.

The protrusion 85 is disposed at a front end portion of the right surface of the left main-body side wall 70L. That is, in the main casing 2, the protrusion 85 is disposed most upstream in an attachment direction of the drawer frame 239, i.e., in a direction orienting from the front to the rear. The protrusion 85 protrudes rightward from the right surface of the left main-body side wall 70L. The protrusion 85 has a substantially trapezoidal shape in a plan view and is tapered toward the right with both front and rear end portions chamfered or truncated. The protrusion 85 is positioned lower than the electrode units 76 in the up-down direction in the left main-body side wall 70L in order to prevent the protrusion 85 from interfering with the electrode retaining parts 61 of the process cartridges 217 during insertion of the drawer frame 239 into the main casing 2.

Figure 8B:
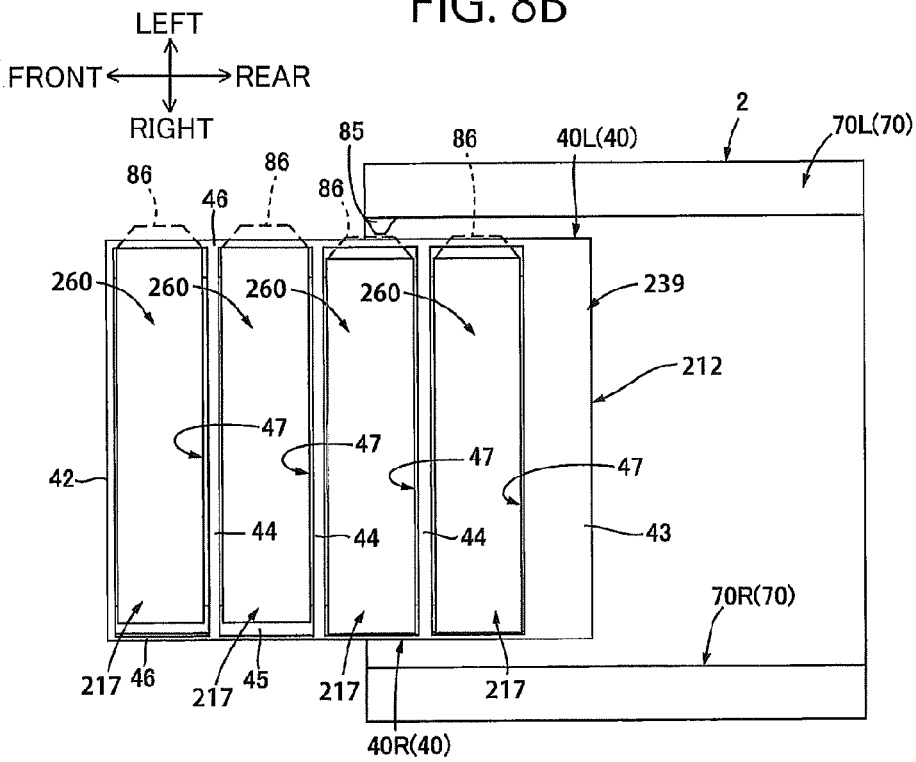
FIG. 8B is a plan view of the drawer unit and the main casing according to the third embodiment, wherein the drawer frame is in a position between the pulled-out position and the intermediate position.
Figure 10B:
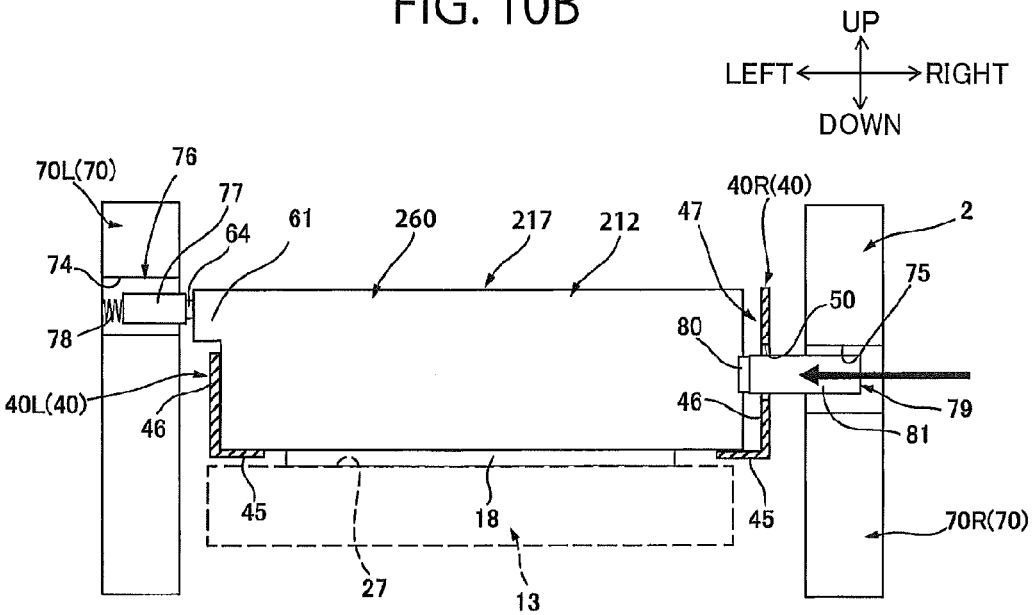
FIG. 10B is a front view of the drawer unit and the main casing according to the third embodiment, wherein the process cartridge of the third embodiment is in an advanced position.

Each of the process cartridges 217 has a casing 260 on which an interference portion 86 is disposed for providing abutment with the protrusion 85 provided on the left main-body side wall 70L of the main casing 2. Specifically, as shown in FIGS. 8A and 8B, the interference portion 86 protrudes leftward from a left surface of the casing 260. The interference portion 86 has a substantially trapezoidal shape in a plan view and is tapered toward the left with both front and rear end portions chamfered or truncated. The interference portion 86 is positioned lower than the electrode retaining part 61 on the left surface of the casing 260 in the up-down direction. In FIGS. 10A and 10B, the protrusion 85 and interference portion 86 are not illustrated.

The process cartridges 217 are displaced leftward in the respective cartridge housing spaces 47 when mounted in the drawer frame 239 in the pulled-out position, as shown in FIG. 8A. In other words, at this time, the process cartridges 217 are in the advanced position. The interference portion 86 is positioned leftward of the left side wall 40L of the drawer frame 239 in the left-right direction, as shown by a broken line in FIG. 8A.

Incidentally, the process cartridges 217 may be displaced rightward in the respective cartridge housing spaces 47 when mounted in the drawer frame 239 in the pulled-out position. That is, the process cartridges 217 may be placed in the retracted position. At this time, a left end portion of the interference portion 86 is substantially flush with the left side wall 40L of the drawer frame 239 (refer to FIG. 8B or 9A).

Next, movement of the drawer frame 239 from the pulled-out position to the mounted position in the third embodiment will be described.

When the process cartridges 217 are in the advanced position, the interference portion 86 is positioned leftward of the left side wall 40L, as shown in FIG. 8A. Thus, when the drawer frame 239 supporting the process cartridges 217 in the advanced position is moved rearward from the pulled-out position toward the intermediate position, a rear end portion of the interference portion 86 of the rearmost process cartridge 217 is first brought into abutment with a front end portion (front-side slope) of the protrusion 85 as the drawer frame 239 enters into the main casing 2. At this time, the electrode unit 76 provided in the left main-body side wall 70L is not brought into abutment with the interference portion 86, since the electrode unit 76 is positioned higher than the protrusion 85.

In this way, the rearmost process cartridge 217 in the advanced position is pressed rightward by the front-side slope of the protrusion 85 in accordance with the rearward movement of the drawer frame 239. The rearmost process cartridge 217 in the advanced position is therefore pushed to move rightward relative to the drawer frame 239 within the rearmost cartridge housing space 47, thereby being moved to the retracted position. The rearmost process cartridge 217 is thus displaced rightward within the rearmost cartridge housing space 47 (see FIG. 8B).

As a result, the left end portion of the interference portion 86 is made flush with the left surface of the left side wall 40L. The interference portion 86 of the rearmost process cartridge 217 is now separated from the protrusion 85.

Figure 9A:
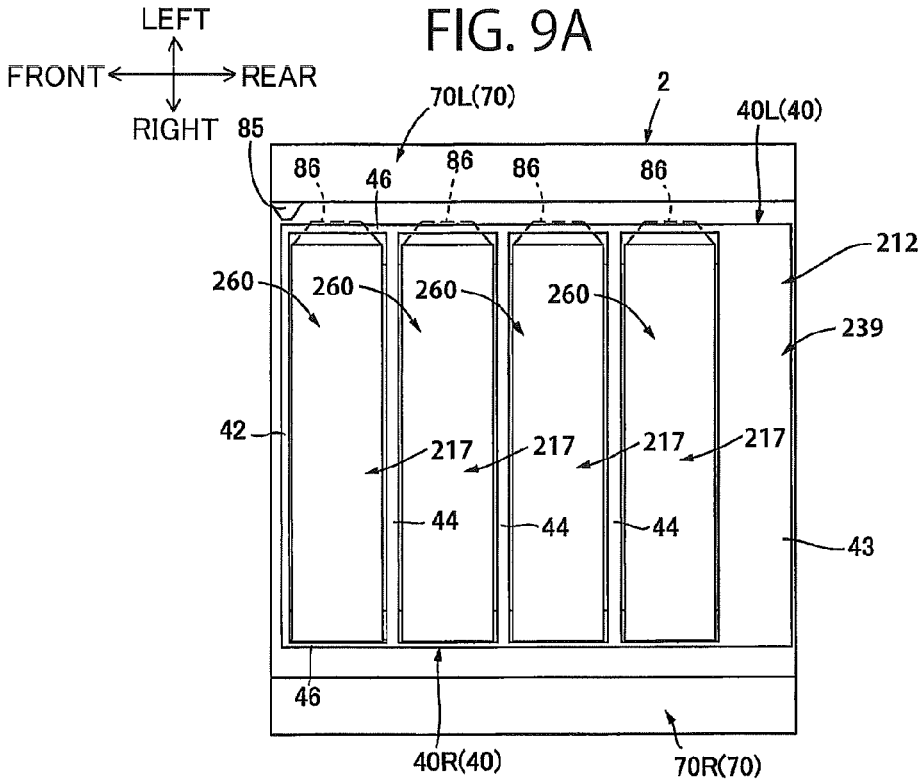
FIG. 9A is a plan view of the drawer unit and the main casing according to the third embodiment, wherein the drawer frame is in the intermediate position.

In this way, as the drawer frame 239 moves rearward, the interference portions 86 of the four process cartridges 217, all of which are in the advanced position, are sequentially brought into abutment with the protrusion 85, thereby moving the process cartridges 217 sequentially from the advanced position to the retracted position. Thus, when the drawer frame 239 reaches the intermediate position, all the process cartridges 217 are placed at the retracted position, as shown in FIG. 9A. In other words, the protrusion 85 achieves displacement of the process cartridges 217 from the advanced position to the retracted position during displacement of the drawer frame 239 from the pulled-out position to the intermediate position.

Put another way, the protrusion 85 displaces all the process cartridges 217 from the advanced position to the retracted position while the drawer frame 239 supporting the process cartridges 217 moves from the pulled-out position to the intermediate position.

Incidentally, in the example of FIG. 8A, the process cartridges 217 are all in the advanced position. However, in case that all the process cartridges 217 are in the retracted position, the interference portions 86 of the process cartridges 217 move past the protrusion 85 on its right side without contacting the same.

Subsequently, the front cover 7 is moved from the opening position to the closing position after the drawer frame 239 reaches the intermediate position. The ascend/descend mechanism 15 thus moves the drawer frame 239 from the intermediate position (shown in FIG. 9A) to the mounted position (shown in FIG. 10A).

The main-body couplings 79 then advance leftward from the non-transmission position to reach the transmission position. The process cartridges 217 at the retracted position are thus pressed leftward by the corresponding main-body couplings 79 and are caused to move leftward (see FIG. 10B).

Figure 9B:
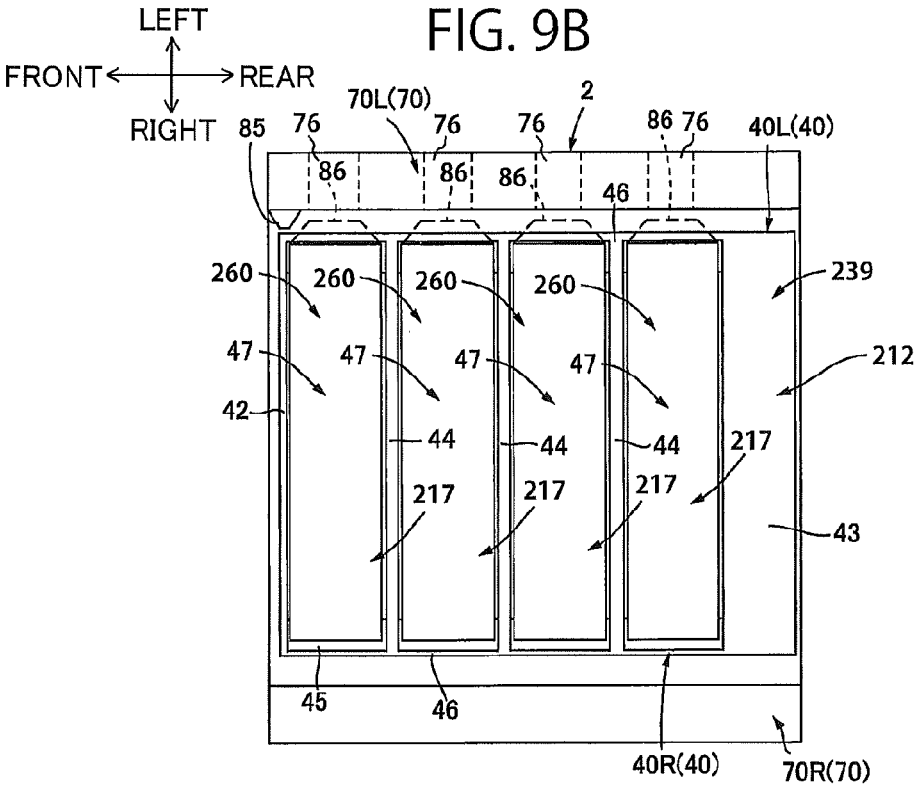
FIG. 9B is a plan view of the drawer unit and the main casing according to the third embodiment, wherein the drawer frame is in the mounted position.

As a result, as illustrated in FIGS. 9B and 10B, the process cartridges 217 are moved from the retracted position to the advanced position and the electrode contacts 64 are brought into contact with the right end portions of the corresponding main-body contacts 77. That is, in the third embodiment, the main-body coupling 79 functions to move the process cartridge 217 from the retracted position to the advanced position when the drawer frame 239 is in the mounted position.

As described above, the protrusion 85 of the main casing 2 is configured to abut on the interference portions 86 of the process cartridges 217 in the advanced position while the drawer frame 239 is being moved from the pulled-out position to the intermediate position. All of the process cartridges 217 can be thus displaced from the advanced position to the retracted position.

This structure is effective in suppressing occurrence of sliding contact between the electrode contact 64 of the process cartridge 217 supported by the drawer frame 239 and main-body contact 77 of the electrode unit 76 during displacement of the drawer frame 239 from the pulled-out position to the intermediate position.

Further, as illustrated in FIG. 10B, the main-body couplings 79 can move the corresponding process cartridges 217 supported by the drawer frame 239 in the mounted position from the retracted position to the advanced position in the left-right direction.

This means that the drawer frame 239 remains stationary with respect to the up-down direction while the process cartridges 217 are being moved from the retracted position to the advanced position. This structure can ensure reliable contact between the main-body contact 77 of the electrode unit 76 and electrode contact 64 of the process cartridge 217 in the left-right direction.

Further, advancing movement of the main-body couplings 79 from the non-transmission position to the transmission position causes the process cartridges 217 to move from the retracted position to the advanced position. That is, in the third embodiment, displacement of the process cartridges 217 from the retracted position to the advanced position is realized by a force generated upon connection of the main-body couplings 79 to the corresponding cartridge couplings 62 of the process cartridges 217. This configuration eliminates the need to provide any additional member for moving the process cartridges 217 from the retracted position to the advanced position. A simplified configuration for moving the process cartridges 217 can be thus obtained in the depicted structure of the third embodiment.

The depicted structure of the third embodiment can also obtain the similar operational and technical advantages as those of the first embodiment.

8. Variations and Modifications

In the above-described first to third embodiments, the process cartridge 17 (117, 217) is configured as a single unit including the photosensitive drum 18 and developing roller 20. However, alternatively, the process cartridge 17 (117, 217) may be configured of two units, i.e., a drum cartridge and a developing cartridge. In the latter case, the drum cartridge has the photosensitive drum 18, while the developing cartridge has the developing roller 20 and is detachably attachable to the drum cartridge.

Still alternatively, the drawer frame 39 (139, 239) may include the photosensitive drum 18, and a developing cartridge having the developing roller 20 may be detachably attachable to the cartridge housing space 47 of the drawer frame 39 (139, 239). In this case, the developing cartridge serves as an example of the claimed cartridge.

Still alternatively, only a toner cartridge storing toner may be detachably attached to the process cartridge 17 including the developing roller 20 and photosensitive drum 18. In this case, the toner cartridge serves as an example of claimed cartridge.

In the above-described first to third embodiments, the developing roller 20 serves as an example of claimed processing body. However, one of the charging roller 19, developing roller 20 and supply roller 21 may serve as an example of the claimed processing body.

With these configurations, the similar operational and technical advantages as those of the first embodiment can be obtained.

Each of the first through third embodiments and variations may be combined with one another appropriately.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a main casing provided with a main-body electrode;

a cartridge including a processing body elongated in a first direction for image formation and a power-receiving part configured to contact the main-body electrode for receiving power therefrom and for supplying the power to the processing body;

a supporting member configured to support the cartridge therein, the supporting member being movable between a first position and a second position in a second direction generally perpendicular to the first direction, the supporting member at the first position being positioned outside the main casing and the supporting member at the second position being positioned inside the main casing; and a first displacing mechanism configured to move the cartridge supported in the supporting member in the first direction to bring the power-receiving part into abutment contact with the main-body electrode.

2. The image forming apparatus as claimed in claim 1, wherein the main casing includes a belt;

wherein the cartridge includes a photosensitive drum configured to contact the belt;

wherein the supporting member is further configured to move between the second position and a third position in a vertical direction perpendicular to the first direction and the second direction, the belt being separated from the photosensitive drum of the cartridge supported in the supporting member at the second position, the belt being in contact with the photosensitive drum of the cartridge supported in the supporting member at the third position; and wherein the first displacing mechanism is configured to move the cartridge supported in the supporting member in the first direction to cause the power-receiving part to contact the main-body electrode along with movement of the supporting member from the second position to the third position.

3. The image forming apparatus as claimed in claim 2, further comprising an ascend/descend mechanism configured to move the supporting member in the vertical direction between the second position and the third position.

4. The image forming apparatus as claimed in claim 2, wherein the movement of the cartridge in the first direction to cause the power-receiving part to contact the main-body electrode by the first displacing mechanism accompanies movement of the supporting member in the first direction.

5. The image forming apparatus as claimed in claim 4, wherein the first displacing mechanism is configured to move the supporting member in the first direction, the cartridge being immovable relative to the supporting member.

6. The image forming apparatus as claimed in claim 2, wherein the first displacing mechanism is configured to move the cartridge in the first direction relative to the supporting member to cause the power-receiving part to contact the main-body electrode.

7. The image forming apparatus as claimed in claim 2, wherein the main casing further includes an abutting member configured to abut on the cartridge while the supporting member moves from the second position to the third position, the abutting member serving as the first displacing mechanism.

8. The image forming apparatus as claimed in claim 2, further comprising a second displacing mechanism configured to move the cartridge in the first direction to cause the power-receiving part to separate from the main-body electrode along with movement of the supporting member from the third position to the second position.

9. The image forming apparatus as claimed in claim 8, wherein the second displacing mechanism is provided in the supporting member.

10. The image forming apparatus as claimed in claim 8, wherein the second displacing mechanism comprises a resilient member.

11. The image forming apparatus as claimed in claim 1, wherein the main casing includes a belt;

wherein the cartridge includes a photosensitive drum configured to contact the belt;

wherein the supporting member is further configured to move between the second position and a third position in a vertical direction perpendicular to the first direction and the second direction, the belt being in separation from the photosensitive drum of the cartridge supported in the supporting member at the second position, the belt being in contact with the photosensitive drum of the cartridge supported in the supporting member at the third position; and wherein the first displacing mechanism is configured to move the cartridge supported in the supporting member at the third position in the first direction to cause the power-receiving part to contact the main-body electrode.

12. The image forming apparatus as claimed in claim 11, further comprising an ascend/descend mechanism configured to move the supporting member in the vertical direction between the second position and the third position.

13. The image forming apparatus as claimed in claim 11, wherein the first displacing mechanism is configured to move the cartridge in the first direction relative to the supporting member to cause the power-receiving part to contact the main-body electrode.

14. The image forming apparatus as claimed in claim 11, wherein the cartridge further includes a driving-force receiving part configured to receive driving force to be inputted to the processing body; and wherein the main casing further includes a driving-force supplying part configured to supply the driving force to the driving-force receiving part, the driving-force supplying part functioning as the first displacing mechanism.

15. The image forming apparatus as claimed in claim 11, further comprising a second displacing mechanism configured to move the cartridge in the first direction to cause the power-receiving part to separate from the main-body electrode while the supporting member moves from the first position to the second position.

16. The image forming apparatus as claimed in claim 15, wherein the second displacing mechanism is provided in the main casing.

17. The image forming apparatus as claimed in claim 1, wherein the first direction is perpendicular to a vertical direction.

18. The image forming apparatus as claimed in claim 17, wherein the second direction is perpendicular to the vertical direction and the first direction.

19. An image forming apparatus comprising:

a main casing provided with a main-body electrode;

a cartridge including a developing roller extending in a first direction and a cartridge electrode configured to contact the main-body electrode and supply an electric power to the developing roller;

a drawer configured to support the cartridge, the drawer being movable between a first position and a second position in a second direction intersecting the first direction, the drawer at the first position being positioned outside the main casing and the drawer at the second position being positioned inside the main casing, the drawer being configured to move in the first direction to cause contact and separation of the cartridge electrode relative to the main-body electrode; and a first displacing mechanism configured to displace the drawer in the first direction to cause the cartridge electrode to contact the main-body electrode.

20. The image forming apparatus as claimed in claim 19, wherein the main casing includes a belt;

wherein the cartridge includes a photosensitive drum configured to contact the belt;

wherein the drawer is further configured to move between the second position and a third position in a vertical direction perpendicular to the first direction and the second direction, the belt being in separation from the photosensitive drum of the cartridge supported in the drawer at the second position, the belt being in contact with the photosensitive drum of the cartridge supported in the drawer at the third position; and wherein the first displacing mechanism is configured to displace the drawer in the first direction to cause the cartridge electrode to contact the main-body electrode when the drawer moves from the second position to the third position.

* * * * *